US005155754A

United States Patent [19]

Ebersberger et al.

[11] Patent Number: 5,155,754

[45] Date of Patent: Oct. 13, 1992

[54] HIGH FREQUENCY SUPPLY FOR AN X-RAY TUBE

[75] Inventors: Otto Ebersberger, Herzogenaurach; Werner Brandstaetter, Nuremberg, both of Fed. Rep. of Germany

[73] Assignee: Siemens Aktiengesellschaft, Munich, Fed. Rep. of Germany

[21] Appl. No.: 770,247

[22] Filed: Oct. 3, 1991

[30] Foreign Application Priority Data

Nov. 27, 1990 [EP] European Pat. Off. ..... 90122684

[51] Int. Cl.[5] ..... H05G 1/70

[52] U.S. Cl. ..... 378/105; 378/104; 363/71

[58] Field of Search ..... 378/91, 101, 104, 105, 378/106, 107, 114, 115; 363/71

[56] References Cited

U.S. PATENT DOCUMENTS

| | | | |
|---|---|---|---|
| 4,216,382 | 8/1980 | Franke . | |
| 4,266,134 | 5/1981 | Franke et al. . | |
| 4,317,039 | 2/1982 | Romardi | 375/105 |
| 4,439,869 | 3/1984 | Hermeyer et al. . | |
| 4,514,795 | 4/1985 | van der Zwart . | |
| 4,564,742 | 1/1986 | Karlsson | 363/71 |
| 4,807,269 | 2/1989 | Grady | 378/104 |
| 4,928,295 | 5/1990 | Tanaka | 378/104 |

FOREIGN PATENT DOCUMENTS

| | | |
|---|---|---|
| 0180750 | 9/1985 | European Pat. Off. . |
| 3437064 | 4/1986 | Fed. Rep. of Germany . |
| 3625855 | 2/1988 | Fed. Rep. of Germany . |
| 3900146 | 7/1989 | Fed. Rep. of Germany . |
| 2100480 | 12/1982 | United Kingdom . |

*Primary Examiner*—David P. Porta

*Attorney, Agent, or Firm*—Hill, Van Santen, Steadman & Simpson

[57] ABSTRACT

A high-frequency supply for use with an x-ray tube having a central metallic tap includes two inverse rectifiers each having a high-voltage transformers, forming two series-connected high-voltage rectifiers. The tap of the x-ray tube is electrically connected between the two high-voltage rectifiers. Each inverse rectifier has a capacitor associated therewith, with the inverse rectifier connected at the cathode side of the x-ray tube having a capacitor with a higher capacitance than the inverse rectifier connected at the anode side of the x-ray tube. Current flowing in the line connected to the tap between the two high-voltage rectifiers is thus compensated, so that a shift in the center of the high-voltage is avoided.

4 Claims, 1 Drawing Sheet

HIGH FREQUENCY SUPPLY FOR AN X-RAY TUBE

BACKGROUND OF THE INVENTION

1. Field of the Invention

The present invention is directed to a high-frequency supply for an x-ray tube, the supply and the x-ray tube in combination forming a high-frequency x-ray generator.

2. Description of the Prior Art

Voltage supplies for x-ray tubes are known which include two inverse rectifiers respectively forming two resonant circuits which are fed by a d.c. voltage source, with each inverse rectifier in turn feeding a respective high-voltage transformer. An x-ray tube is connected to two series-connected high-voltage rectifiers, with each high-voltage rectifier being fed by one of the high-voltage transformers.

It is known to provide the x-ray tube with a metallic, central tap, which is connected to a line between the two high-voltage rectifiers. A current thereby flows from the tube via the metal tap, this current representing an additional load for the high-voltage side of the x-ray generator.

In a high-frequency x-ray generator of this type, wherein the high-voltage transformers are not rigidly connected at the primary side, but are each supplied by a respective inverse rectifier, a shift in the center of the high-voltage arises due to the current from the central metallic tap.

SUMMARY OF THE INVENTION

It is an object of the present invention to provide a high-frequency supply for an x-ray tube wherein a shift in the center of the high-voltage is avoided.

The above object is achieved in accordance with the principles of the present invention in a supply having resonant circuit inverse rectifiers each feeding a high-voltage transformer, wherein the respective impedances of the resonant circuits are different. This can be accomplished by making the respective capacitances of the capacitors in the respective inverse rectifiers of different values. If the capacitance of the resonant circuit capacitor of the inverse rectifier at the cathode side of the x-ray tube is larger in comparison to the capacitance of the resonant circuit capacitor of the inverse rectifier at the anode side, the current flowing from the central metallic tap can be compensated, by appropriate dimensioning of these different capacitors.

In a further embodiment of the invention the capacitance of one of the resonant circuits is switchable. In this manner, the high-voltage supply can be used both in combination with an x-ray tube with a central tap, and in combination with an x-ray tube without a central tap. If the supply is used with a tube not having a central tap, the capacitors are switched so that the inverse rectifiers have the same capacitance. If the supply is used with an x-ray tube having a metal tap, the capacitors are switched so that the respective capacitances of the inverse rectifiers are different.

DESCRIPTION OF THE PREFERRED EMBODIMENTS

Figure 1:
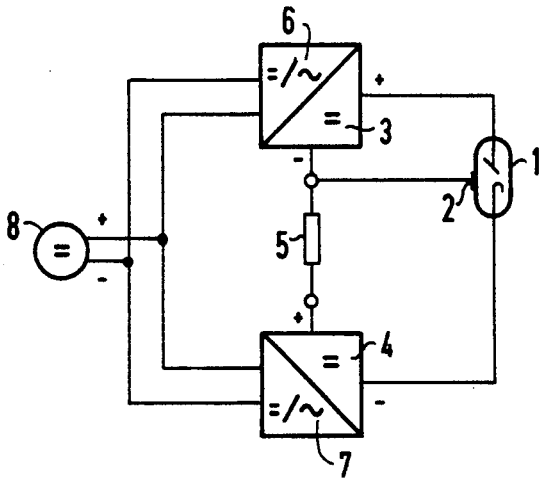
FIG. 1 is a schematic block circuit diagram of a high-frequency supply for an x-ray tube constructed in accordance with the principles of the present invention.

As shown in FIG. 1, an x-ray tube 1 has a central metallic tap 2, and has an anode connected to the positive pole of a high-voltage rectifier 3, and a cathode connected to the negative pole of another high-voltage rectifier 4. The high-voltage rectifiers 3 and 4 are connected in series via a precision resistor 5. The center tap 2 is connected to the negative pole of the high-voltage rectifier 3.

The high-voltage rectifiers 3 and 4 have inverse rectifiers 6 and 7 allocated thereto. The inverse rectifiers 6 and 7 are supplied by a d.c. voltage source 8. The high-voltage rectifiers 3 and 4 are respectively preceded by high-voltage transformers 9 and 10, as shown in FIGS. 2 through 4, which are supplied by the corresponding inverse rectifier 6 and 7.

Figure 2:
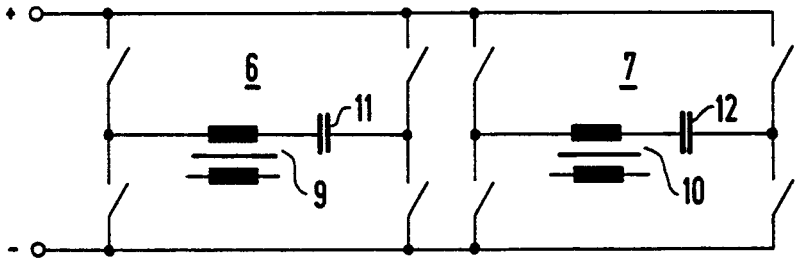
FIGS. 2, 3 and 4 respectively show different embodiments of the inverse rectifier circuit of FIG. 1.

As shown in embodiment of FIG. 2, the high-voltage transformers 9 and 10 in combination with capacitors 11 and 12 form respective series resonant circuits connected diagonally across the respective inverse rectifiers 6 and 7. The capacitance of the capacitor 12 of the inverse rectifier 7 at the cathode side is higher than the capacitance of the capacitor 11 of the inverse rectifier 6 at the anode side. As a result, the current in the line leading from center tap 2 is compensated as described above.

Figure 3:
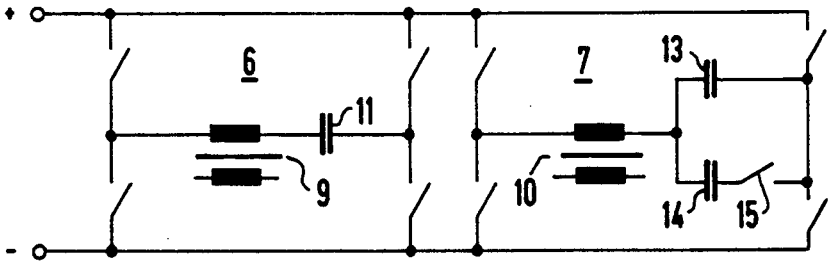

In the embodiment of FIG. 3, two capacitors 13 and 14 are provided in the inverse rectifier 7 at the cathode side. The capacitor 13 has the same capacitance as the capacitor 11, and is used only if an x-ray tube without the center tap is employed. If an x-ray tube with a central tap is used, as shown in FIG. 1, the capacitor 14 is added into the circuit by a switch 15, resulting in an increase in the capacitance of the resonant circuit of the inverse rectifier 7. The circuit of FIG. 3, consequently, can be optionally employed in combination with an x-ray tube with or without a central tap.

Figure 4:
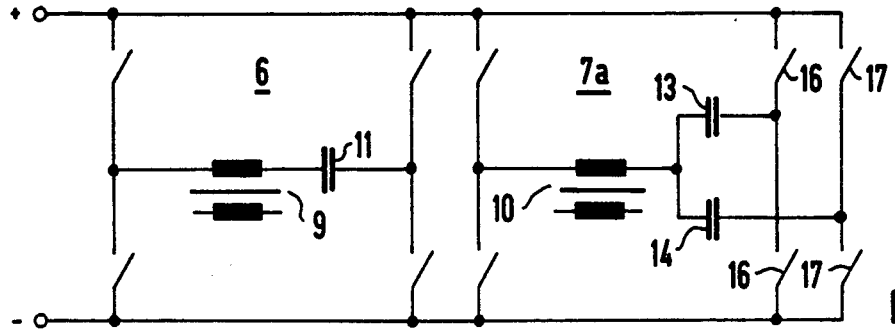

The same is true of the embodiment shown in FIG. 4. In this embodiment, the inverse rectifier **7*a* at the cathode side has two separately driveable half-bridges 16 and 17. The half-bridge 16 is used (i.e., the switches thereof are closed) given the use of an x-ray tube without a central tap. This causes only the capacitor 13 to connected in the resonant circuit of the inverse rectifier 7*a*. Both half-bridges 16 and 17 are used (i.e., the switches of both are closed) when an x-ray tube having a central tap is employed. This causes both capacitors 13 and 14 to be connected in the resonant circuit of the inverse rectifier 7*a*, thereby increasing the capacitance. In the embodiment of FIG. 4, it is also possible to use only the half-bridge 17, and thus to disconnect entirely the capacitor 13, if the capacitor 14** has a sufficiently high capacitance.

Although modifications and changes may be suggested by those skilled in the art, it is the intention of the inventors to embody within the patent warranted hereon all changes and modifications as reasonably and properly come within the scope of their contribution to the art.

We claim as our invention:

1. A high-voltage supply circuit for feeding an x-ray tube having an anode side and a cathode side, said circuit comprising:

first and second resonant circuit inverse rectifiers connectable to a d.c. voltage source;

first and second high-voltage transformers respectively fed by said first and second resonant circuit inverse rectifiers;

first and second high-voltage rectifiers connected in series and respectively connectable to the anode side and to the cathode side of an x-ray tube, said first and second high-voltage rectifiers being respectively fed by said first and second high-voltage transformers; and said first and second resonant circuit inverse rectifiers each having a resonant circuit impedance, and said respective resonant circuit impedances of said first and second resonant circuit inverse rectifiers being different.

2. A high-frequency voltage supply circuit as claimed in claim 1 wherein said resonant circuit impedances are respectively different capacitances, and wherein said second resonant circuit inverse rectifier, connectable at said cathode side of said x-ray tube, has a larger capacitance than said first resonant circuit inverse rectifier, connectable at said anode side of said x-ray tube.

3. A high-frequency voltage supply circuit as claimed in claim 2, further comprising:

means in at least one of said first and second resonant circuit inverse rectifiers for switching the magnitude of said capacitance.

4. A high-frequency voltage supply circuit as claimed in claim 3 wherein said at least one resonant circuit inverse rectifier includes two capacitors, and wherein said means for switching is connected to said two capacitors for selectively connecting one or both of said two capacitors in said at least one resonant circuit inverse rectifier.

* * * * *